US008764164B1

(12) United States Patent
Anderson

(10) Patent No.: US 8,764,164 B1
(45) Date of Patent: Jul. 1, 2014

(54) PRINTER SERVICE STATION WITH SPITTOON PLOW

(71) Applicant: Hewlett-Packard Development Company, L.P., Houston, TX (US)

(72) Inventor: Jeffrey Jay Anderson, Pittsburgh, PA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/756,375

(22) Filed: Jan. 31, 2013

(51) Int. Cl.
*B41J 2/165* (2006.01)
*B41J 2/17* (2006.01)

(52) U.S. Cl.
CPC ..... *B41J 2/1721* (2013.01); *B41J 2/16523* (2013.01)
USPC ..... 347/36

(58) Field of Classification Search
CPC ..... B41J 2002/1742; B41J 2/16523
USPC ..... 347/35, 36
See application file for complete search history.

(56) References Cited

U.S. PATENT DOCUMENTS 5,791,793 A * 8/1998 Nagahata ..... 400/120.01
5,905,513 A 5/1999 Brandon et al.
6,250,736 B1 6/2001 Wojcik
6,264,322 B1 7/2001 Axtell et al.
6,318,838 B1 11/2001 Anderson et al.
6,340,220 B1 1/2002 Gaylor et al.
6,402,291 B1 6/2002 Millman et al.
6,409,303 B1 6/2002 Anderson et al.
6,454,385 B1 9/2002 Anderson et al.
6,536,867 B1 * 3/2003 James et al. ..... 347/36
6,644,776 B1 11/2003 Barinaga et al.
6,648,448 B1 * 11/2003 Ma et al. ..... 347/32
6,860,582 B2 3/2005 Vega et al.
6,929,347 B2 * 8/2005 Ara ..... 347/33
7,001,009 B2 * 2/2006 Sakurai ..... 347/33
7,011,388 B2 3/2006 Lodal et al.
7,448,726 B2 * 11/2008 Harper et al. ..... 347/33
7,722,151 B2 5/2010 Elenes et al.
7,914,110 B2 3/2011 Curcio et al.
8,033,638 B2 * 10/2011 Umeda ..... 347/33
8,272,714 B2 9/2012 Blackman et al.
2004/0085392 A1 5/2004 Walsh et al.
2005/0062796 A1 * 3/2005 Mott et al. ..... 347/33
2011/0057990 A1 3/2011 Heo et al.
2012/0320126 A1 12/2012 Martin et al.

* cited by examiner

*Primary Examiner* — Stephen Meier
*Assistant Examiner* — Alexander D Shenderov

(57) ABSTRACT

A service station for use with a printer includes a spittoon. The service station includes a shuttle movable along a shuttle axis, and a spittoon plow supported by the shuttle. The spittoon plow includes at least one blade portion that is angled to spread the service ink along both a width and a length of the spittoon.

14 Claims, 8 Drawing Sheets

PRINTER SERVICE STATION WITH SPITTOON PLOW

BACKGROUND

Printing systems such as ink jet printers typically employ a printhead having print nozzles to expel fluid droplets onto print media, which dry to form images. The print nozzles may become clogged with ink or particulates and are prone to clogging or other performance-deteriorating problems, resulting in inefficient operation of the printhead and reduced print quality. To maintain or clean the print heads, a printer often employs a service station to provide one or more servicing procedures, including spitting, wiping, capping, priming and/or purging.

DETAILED DESCRIPTION

Figure 1:
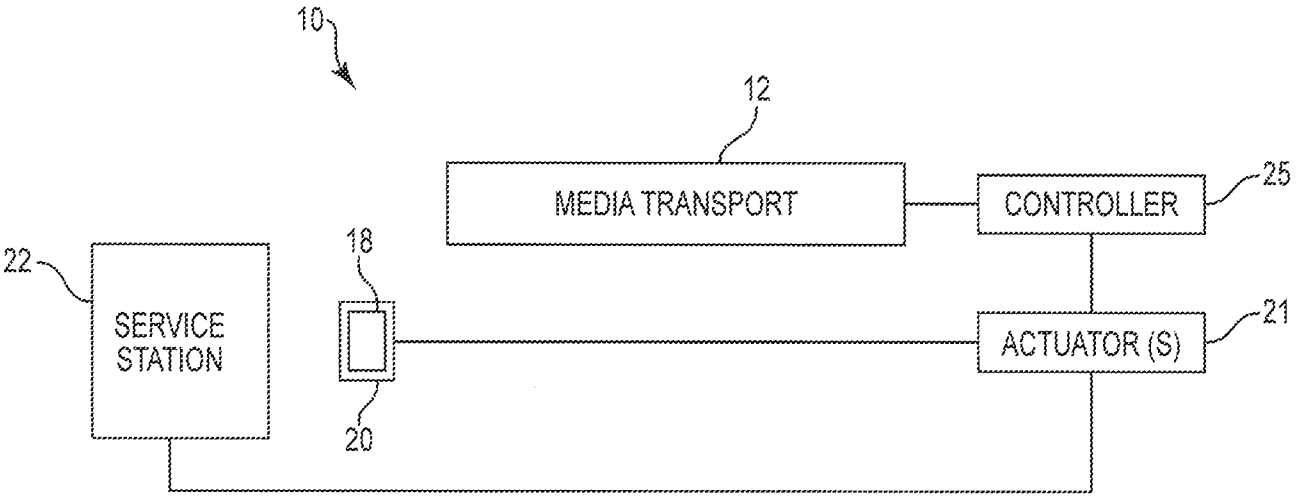
FIG. 1 is a block diagram illustrating a printing system according to one implementation.

In the following detailed description, reference is made to the accompanying drawings which form a part hereof, and in which is shown by way of illustration specific embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims. It is to be understood that features of the various embodiments described herein may be combined with each other, unless specifically noted otherwise.

Fluid ejection systems such as, for example, ink jet printers, employ a fluid delivery system that includes a printhead mechanism (or "pen") that expels fluid droplets onto a print media. A fluid supply cartridge may be permanently or removably attached to a printhead mechanism (e.g., "on-axis" printing), or fluidly coupled to a separate, self-contained fluid supply reservoir that is remote from the printhead mechanism (e.g., "off-axis" printing). Such printhead mechanisms are susceptible to clogging, becoming contaminated, or drying out, which can affect the print quality.

To service or maintain printhead mechanisms, printers often employ a service station. The service station is typically supported by the printer chassis so the printhead can be automatically moved to the service station for maintenance. To prevent print nozzles of a printhead mechanism from drying out during periods of non-use, service stations often include a capping mechanism configured to receive the printhead mechanism. To prevent the nozzles from drying out, the capping mechanism includes a cover and/or a seal that surrounds or encircles the print nozzles of the printhead mechanism. Also, to purge fluid (e.g., ink or air) from the print nozzles, some service stations provide a priming function.

During operation, clogs in the printhead are periodically cleared by firing a number of drops of ink through each of the nozzles in a process known as "spitting," with the waste ink (or "service ink") being collected in a "spittoon" reservoir portion of the service station. Spittoons are essentially large buckets over which the printhead is parked when droplets are ejected during a spitting routine. After spitting, uncapping, or occasionally during printing, most service stations have an elastomeric wiper that wipes the printhead surface to remove ink residue, as well as any paper dust or other debris that has collected on the printhead.

Holding service ink in a service station spittoon can be tricky with design constraints for life, size, and cost. The service station is typically sized to hold a lifetime supply of service ink. The liquid portion of the service ink will flow, and can eventually be held in absorbent material that is shaped to fill the spittoon volume efficiently. However, a portion of this ink becomes a solid sludge that cannot be absorbed into the absorbers because of pigment in the ink or other chemicals that can come out of the solution as solid particles. The solid portion of the service ink (e.g., sludge made of pigment and liquid that was not absorbed) does not flow very easily and tends to mound up, which results in inefficient packing densities. When this occurs, the sludge builds up and does not flow or pack into all available area within the service station spittoon. This inefficiency results in a larger required spittoon volume to hold the service ink for the intended life of the service station, and can result in a larger product footprint and a higher cost. This inefficiency can also diminish the expected life of the service station.

Service ink can be treated either passively or actively. In the passive case, the service ink can be deposited into the spittoon and be allowed to buildup and slump, as one might observe with sand continuously being deposited in the same place a small portion at a time. In the active case, with strictly linear motion, a wiper or scraper mechanism can move the service ink to another location when the mound of ink grows too great. If the movement of the scraper mechanism is long in relation to the length of the spittoon, and small in relation to the width of the spittoon, the packing efficiency is not optimized. In the active case, with radial motion, the available width may be restricted, but the scraper mechanism may be large relative to the width. Length in this case is restricted, so overall efficiency may be high, but capacity is low.

Implementations disclosed herein improve packing efficiency of a service station spittoon over that of other designs. One implementation improves packing density by using a mechanical means over a large area of the spittoon, shaping the mechanical means to actively move the sludge into intended areas, and coupling this action to the dynamics of how the service ink is deposited into the spittoon. In one implementation, the mechanical means comprises an angled plow design with a linear motion that takes advantage of both length and width to increase packing efficiency by spreading the service ink across both dimensions of the spittoon.

FIG. 1 is a block diagram illustrating a printing system 10 according to one implementation. The printing system 10 may comprise, in some implementations, an inkjet printer. The printing system 10 includes media transport 12, controller 25, actuator(s) 21, carriage 20, and service station 22. The media transport 12 advances a print medium (not shown) through a print zone. The media transport 12 may include one or more of a drum, rollers, belts, or other suitable devices for advancing the print medium from an input location through the print zone. In some implementations, the print medium may comprise paper or another suitable medium on which an image may be formed by printing. In one implementation, the media transport 12 comprises a mechanism configured to pick an individual sheet of media from a stack of media and supply the individual sheet to the print zone. The media transport 12 may also be configured to withdraw printed-upon media from the print zone and transport withdrawn media to an output tray, bin or the like.

The printing system 10 includes a carriage 20 that supports at least one pen 18. The carriage 20 may be moved between at least two different positions. In one position, the carriage 20 is positioned within a print zone for printing on the print medium. In another position, the carriage 20 is positioned inside of or adjacent to service station 22 for maintenance operations. In operation, the carriage 20 moves between these positions and may also move to other positions. Each pen 18 comprises one or more printheads configured to dispense imaging material such as ink, upon the print medium. In some implementations, the carriage 20 supports multiple pens. Actuator 21 comprises one or more actuators configured to move carriage 20 and pen 18 so as to selectively position pen 18 opposite to the print medium in the print zone or adjacent to service station 22 under control of the controller 25. Service station 22 includes one or more components configured to perform one or more servicing operations upon one or more of the pens 18. In one implementation, service station 22 includes a wiping element to wipe pen 18, a capping element to cap pen 18, a spittoon, and a spittoon plow 200 (FIG. 2).

To service or maintain the pens 18, the printing system 10 employs the service station 22. The service station 22 provides service station operations (e.g., spitting, priming, capping, wiping, etc.) to the pens 18 during non-printing or periods of non-use. Prior to a print job, and/or after a print job, the controller 25 may cause the carriage 20 to move to a home position adjacent to the service station 22 to perform maintenance functions and service the pens 18. Such maintenance functions include "spitting" in which the pens 18 "spit" or discharge ink through their nozzles to clear ink that has partially dried or degraded, and cleaning, during which the nozzles are wiped, thereby removing ink residue that may build up during the printing process. The ink that is discharged during spitting or other operations is referred to as service ink, and is stored in a spittoon 708 (FIG. 7) of service station 22. Service station 22 includes a spittoon plow 200 (FIG. 2) to move the service ink around in the spittoon 708 to increase packing efficiency.

Figure 2:
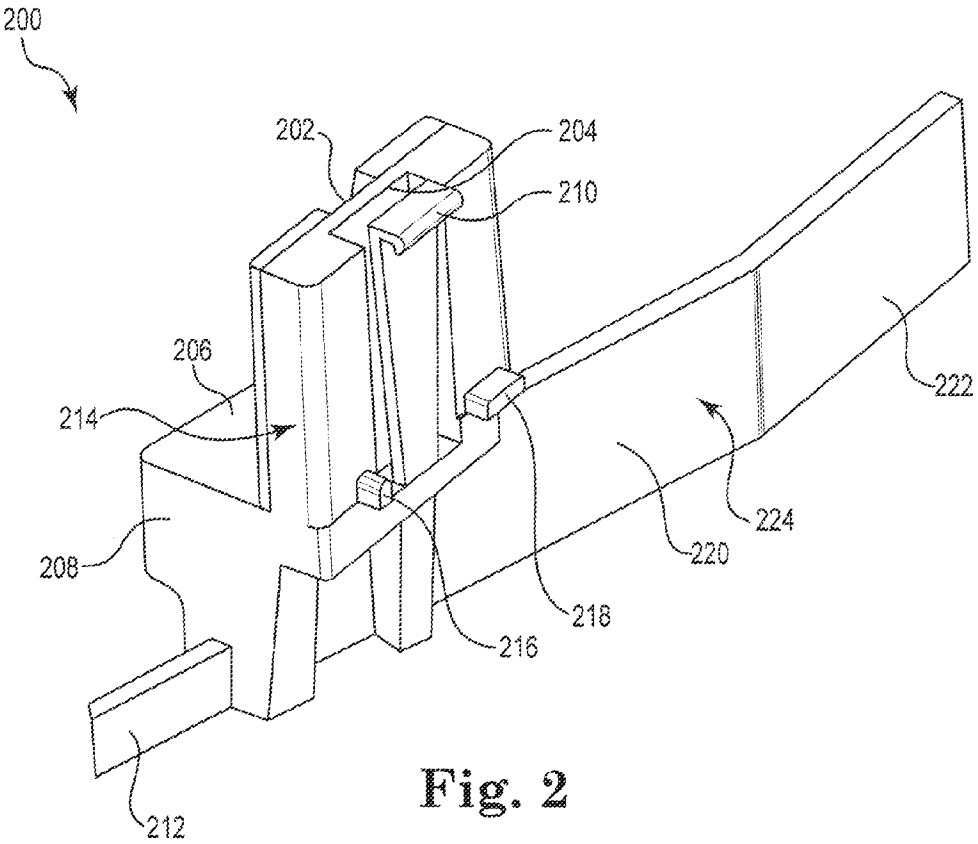
FIG. 2 is a diagram illustrating a back side of a spittoon plow configured to be used in the service station shown in FIG. 1 according to one implementation.

FIG. 2 is a diagram illustrating a back side 224 of a spittoon plow 200 configured to be used in the service station 22 shown in FIG. 1 according to one implementation. Spittoon plow 200 includes base 208, first blade portion 212, attachment feature 214, second blade portion 220, and third blade portion 222. Second blade portion 220 has a height that is substantially the same as the height of the third blade portion 222. The first blade portion 212 has a height that is about half of the height of the second blade portion 220 and the third blade portion 222. The first blade portion 212 extends horizontally away from a first side of the base 208.

The second blade portion 220 extends horizontally away from a second side of the base 208, which is opposite the first side of the base 208. In one implementation, the first blade portion 212 and the second blade portion 220 extend horizontally away from the base 208 in opposite but substantially parallel directions. The third blade portion 222 extends horizontally away from the second blade portion 220, and is angled with respect to the second blade portion 220, so the second blade portion 220 and the third blade portion 222 are not parallel. In one implementation, the blade portions 212, 220, and 222 are substantially planar and have a non-vertical orientation, with the top of each of the blade portions 212, 220, and 222 positioned forward of the bottom of the blade portions (e.g., from a side view, the tops of the blade portions are at about 11 o'clock and the bottoms of the blade portions are at about 5 o'clock). The blade portions 212, 220, and 222 are configured to wipe or scrape service ink in a service station spittoon.

A top surface of the base 208 defines a platform 206. The attachment feature 214 extends vertically upward from a back edge of the platform 206, and is configured to be attached to a shuttle 302 (FIG. 3) of the service station 22. The attachment feature 214 includes a trench 202 that extends vertically upward along a front side of the attachment feature 214, from a bottom of the attachment feature 214 to a top of the attachment feature 214, and a trench 204 that extends vertically upward along a back side of the attachment feature 214, from a bottom of the attachment feature 214 to a top of the attachment feature 214. A securing clip 210 extends vertically upward along the back side of the attachment feature 214, from a bottom of the attachment feature 214 to a top of the attachment feature 214, and is aligned with the trench 204. The attachment feature 214 also includes two stops 216 and 218 positioned near a bottom of the back side of the attachment feature 214 on opposing sides of the trench 204.

Figure 3:
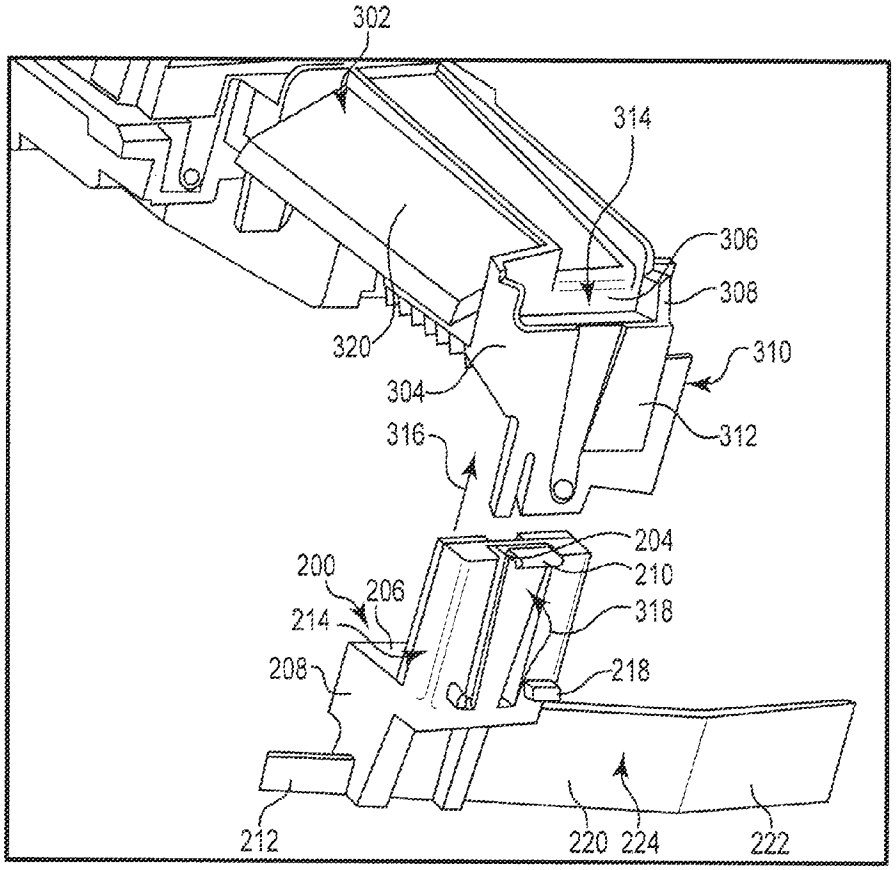
FIG. 3 is a diagram illustrating the spittoon plow shown in FIG. 2 aligned for attachment to a shuttle of the service station according to one implementation.

FIG. 3 is a diagram illustrating the spittoon plow 200 shown in FIG. 2 aligned for attachment to a shuttle 302 of service station 22 according to one implementation. As shown in FIG. 3, shuttle 302 includes an attachment feature 310 configured for attachment to the attachment feature 214 of the spittoon plow 200. The attachment feature 310 includes two side walls 304 and 308, and a front wall 312. The two side walls 304 and 308 extend from a base portion 306 of the shuttle 302 to the front wall 312. The base portion 306, the side walls 304 and 308, and the front wall 312 define a cavity 314 sized for receiving the attachment feature 214 of the plow 200. The attachment feature 214 is sized for insertion into the cavity 314. To perform the attachment, a top portion of the securing clip 210 is pushed into the trench 204, as indicated by arrow 318, while the attachment feature 214 is inserted vertically upward into the cavity 314, as indicated by arrow 316. Shuttle 302 includes a surface 320 for receiving service ink during a spitting process.

Figure 4:
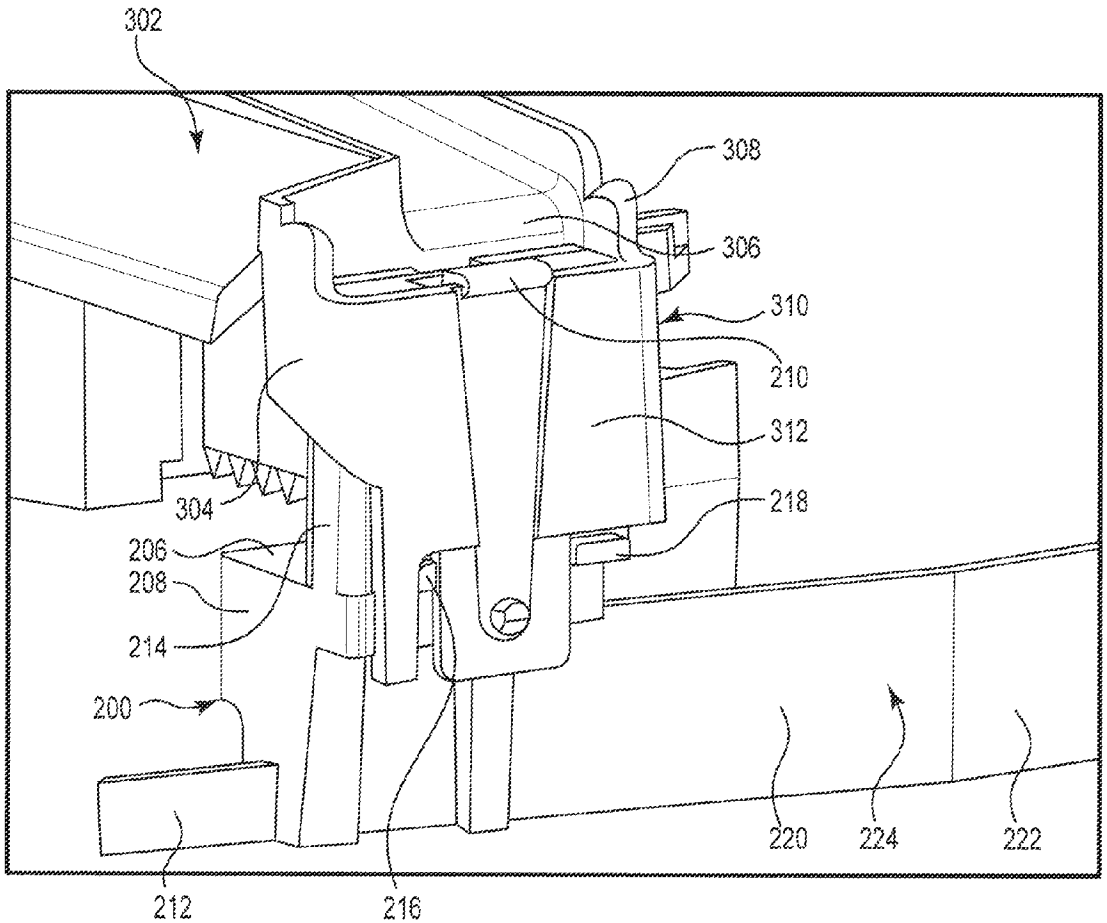
FIG. 4 is a diagram illustrating the spittoon plow shown in FIG. 2 after attachment to the shuttle of the service station according to one implementation.

FIG. 4 is a diagram illustrating the spittoon plow 200 shown in FIG. 2 after attachment to the shuttle 302 of service station 22 according to one implementation. The attachment feature 214 is inserted into the cavity 314 until the top portion of the securing clip 210 reaches a top surface of the front wall 312, at which point the top portion of the securing clip 210 snaps outward and away from the trench 204, and into engagement with the top of the front wall 312. The securing clip 210 prevents the attachment feature 214 from sliding vertically down the cavity 314. At this point, the stops 216 and 218 on the attachment feature 214 contact a bottom portion of the front wall 312 and prevent further upward vertical movement of the attachment feature 214 into the cavity 314, so the plow 200 is securely attached to the shuttle 302.

Figure 5:
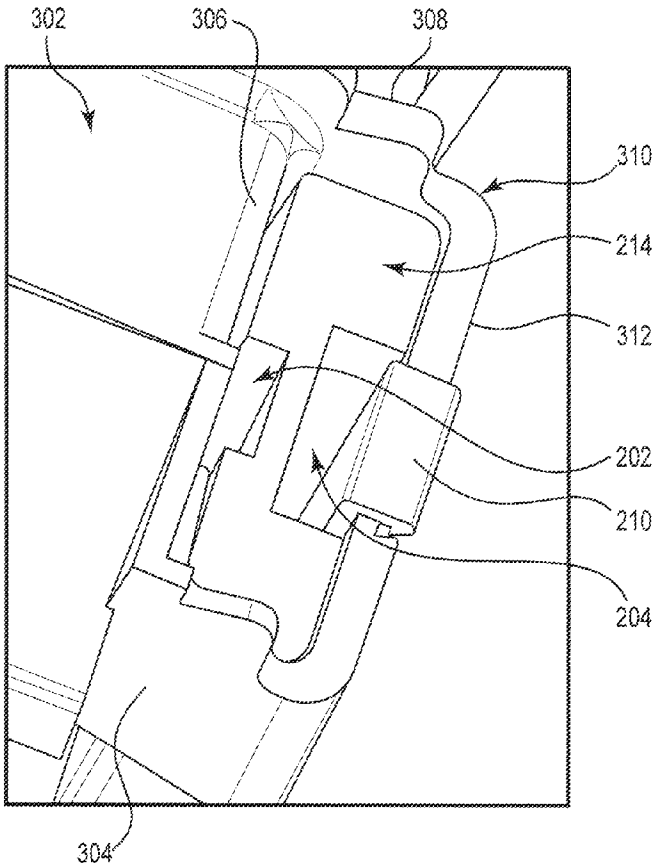
FIG. 5 is a diagram illustrating a top portion of the attachment feature of the spittoon plow attached to the shuttle according to one implementation.

FIG. 5 is a diagram illustrating a top portion of the attachment feature 214 of the spittoon plow 200 attached to the shuttle 302 according to one implementation. As shown in FIG. 5, the top portion of the securing clip 210 is secured to the top of the front wall 312, and prevents the attachment feature 214 from sliding vertically downward.

Figure 6:
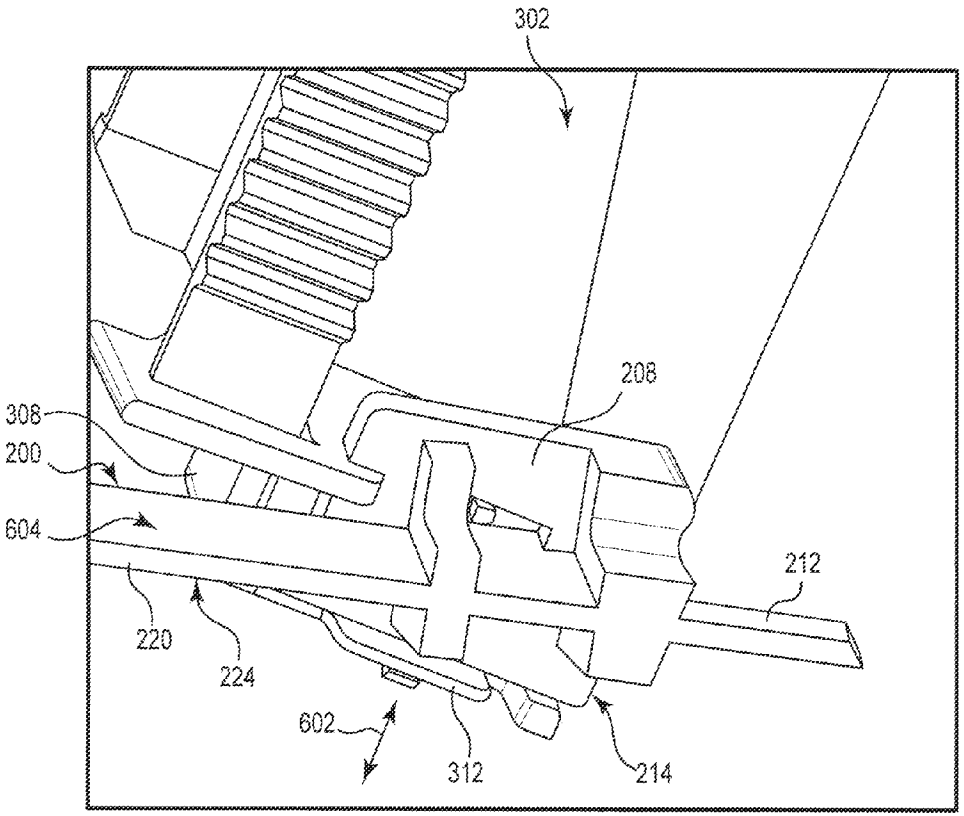
FIG. 6 is a diagram illustrating a bottom view of the spittoon plow attached to the shuttle according to one implementation.

FIG. 6 is a diagram illustrating a bottom view of the spittoon plow 200 attached to the shuttle 302 according to one implementation. FIG. 6 also shows the front side 604 of the spittoon plow 200. The shuttle 302 is configured to move along a shuttle axis in the directions indicated by arrow 602, which is substantially perpendicular to the front wall 312 of the shuttle 302. As shown in FIG. 6, the blade portions 212 and 220 are not parallel to the front wall 312, but rather are angled with respect to the front wall 312, and form a non-perpendicular angle with the direction of movement 602 of the shuttle 302. In one implementation, blade portion 222 (FIG. 2) also forms a non-perpendicular angle with the direction of movement 602 of the shuttle 302.

Figure 7:
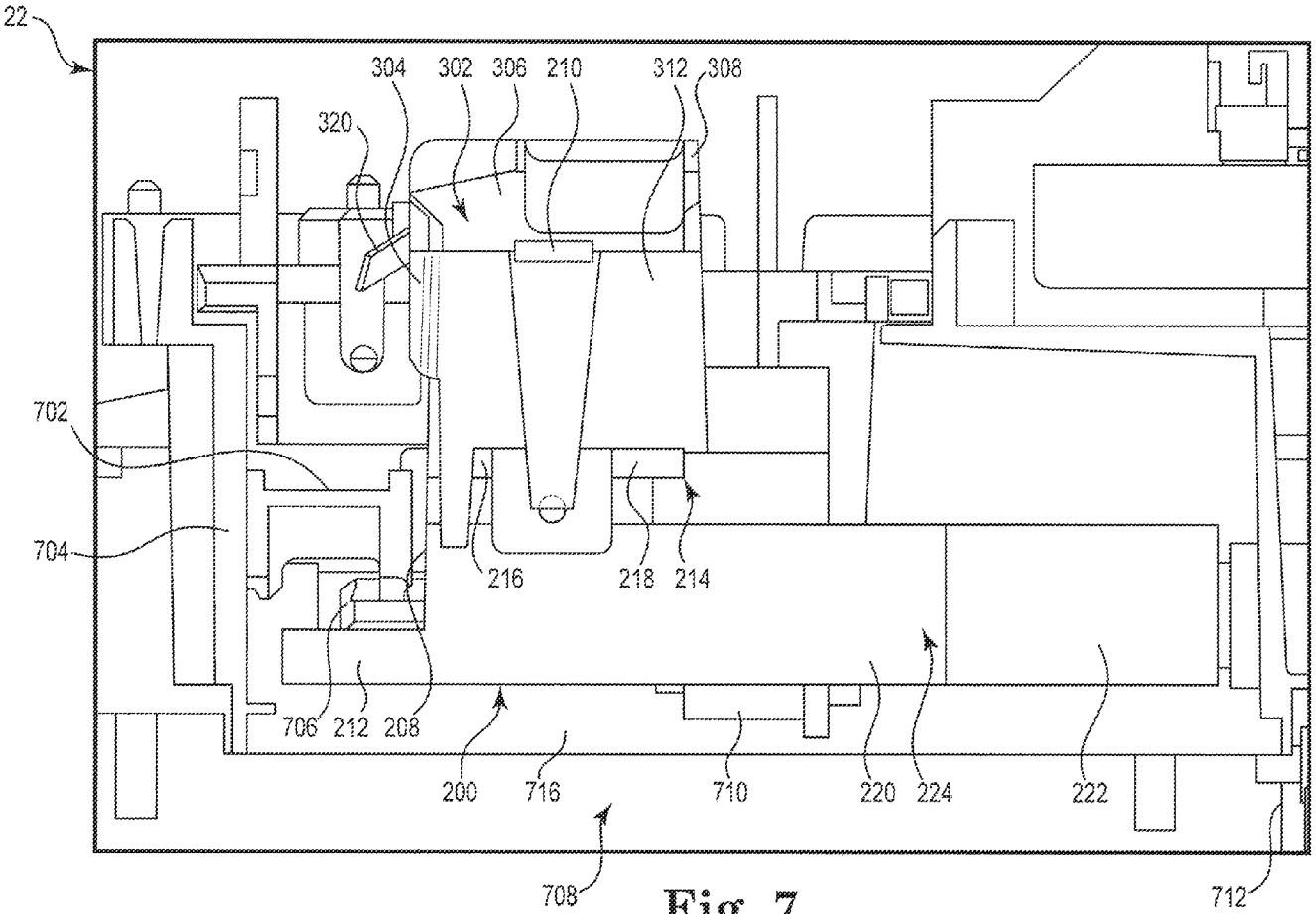
FIG. 7 is a diagram illustrating the spittoon plow and the shuttle positioned within the service station according to one implementation.

FIG. 7 is a diagram illustrating the spittoon plow 200 and the shuttle 302 positioned within the service station 22 according to one implementation. The view shown in FIG. 7 is from the front of the service station 22 looking toward the back of the service station 22. It is noted that the back side 224 of the spittoon plow 200 faces the front of the service station 22. As shown in FIG. 7, the service station 22 includes shuttle 302, spit platform 702, shuttle drive axle 706, spittoon 708, shuttle drive pinion 710, and spittoon plow 200. Shuttle drive axle 706 and shuttle drive pinion 710 are part of a shuttle drive system that moves shuttle 302 along the shuttle axis 602 (FIG. 6), which is perpendicular to the plane of the paper in FIG. 7. Spittoon 708 includes left spittoon side wall 704, right spittoon side wall 712, back spittoon wall 716, and a spittoon floor and front spittoon wall (not shown in FIG. 7). The distance between spittoon side wall 704 and spittoon side wall 712 defines a width of the spittoon 708, with the width being defined in the illustrated implementation as being perpendicular to the direction of movement of the shuttle 302. The length of the spittoon 708 is defined as the distance between the front and back walls of the spittoon 708, with the length being defined in the illustrated implementation as being parallel to the direction of movement of the shuttle 302. In the illustrated implementation, the spittoon plow 200 extends across substantially the entire width of the spittoon 708. The bottom of the blade portions 212, 220, and 222 of the spittoon plow 200 are parallel to the spittoon floor, and positioned above the spittoon floor.

Figure 8:
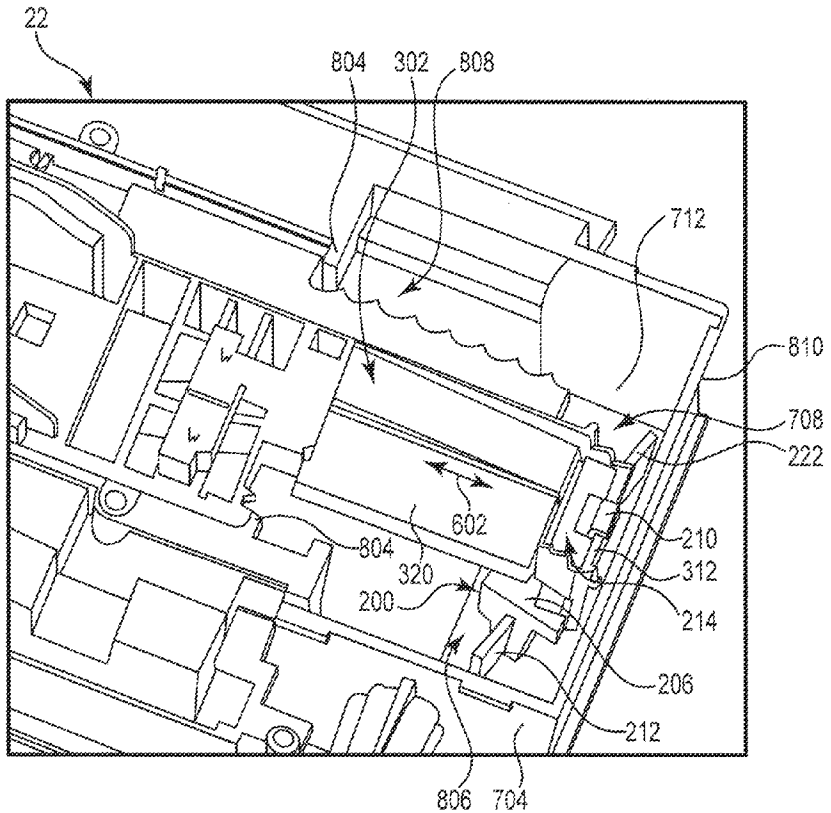
FIG. 8 is a diagram illustrating a portion of the service station including the spittoon plow and the shuttle according to one implementation.

FIG. 8 is a diagram illustrating a portion of the service station 22 including the spittoon plow 200 and the shuttle 302 according to one implementation. In one implementation, in addition to supporting the spittoon plow 200, the shuttle 302 also supports a capping assembly (not shown) for capping and uncapping pen 18, and a wiper assembly (not shown) for wiping pen 18. In operation, the shuttle 302 moves along the shuttle axis in the directions indicated by arrow 602 between a first position and a second position. The direction of movement 602 of the shuttle 302 is substantially perpendicular to the front wall 312 of the shuttle 302, and substantially perpendicular to front spittoon wall 810. A shuttle drive propels or moves the shuttle 302 forward and rearward along the shuttle axis 602 between stop positions. In FIG. 8, the shuttle 302 is shown in its farthest forward position (i.e., the forward home position), and further forward movement is prevented by forward stops 804.

In the forward home position, the front wall 312 of the shuttle 302 is positioned parallel to and immediately adjacent to the front spittoon wall 810. The blade portions 212, 220, and 222 of the spittoon plow 200 are not parallel to the front wall 312 and front spittoon wall 810, but rather are angled with respect to these walls 312 and 810, and form a non-perpendicular angle with the direction of movement 602 of the shuttle 302. As the shuttle 302 drives the spittoon plow 200 along the shuttle axis 602 from a front portion of the spittoon 708 to a back portion of the spittoon 708, the plow 200 engages or scrapes the service ink in the spittoon 708. In the illustrated implementation, the blade portions 212, 220, and 222 of the spittoon plow 200 are angled to move the service ink in a generally diagonal direction from a front left portion 806 of the spittoon 708 to a back right portion 808 of the spittoon 708. Thus, the one-dimensional movement of the spittoon plow 200 in direction 602 produces a two-dimensional spreading of the service ink across the length and width of the spittoon 708. In one implementation, the non-vertical orientation of the blade portions 212, 220, and 222 of the spittoon plow 200 also forces the service ink vertically downward as the plow 200 is moved from the front of the spittoon 708 to the back of the spittoon 708.

In one implementation, the action of spreading service ink in the spittoon 708 with plow 200 begins when the pen 18 comes out of cap (i.e., when the capping assembly supported by shuttle 302 uncaps the pen 18). When the pen 18 comes out of cap, the shuttle 302 begins moving rearward (i.e., away from wall 810) from the forward home position shown in FIG. 8 until it reaches the rear stops (not shown). Thus, the spittoon plow 200, which is located at a forward most portion of the shuttle 302, is moved towards the rear. The spittoon plow 200 is angled at a non-perpendicular angle with respect to the direction of movement 602 so that the motion will move any service ink that is exposed to the plow 200 rearwards and from the left wall 704 of the spittoon 708 towards the right wall 712 of the spittoon 708. This motion of the plow 200 is similar to how a knife would be held and moved in order to frost a cake.

The service ink that is moved by the plow 200 is typically deposited there by service algorithms and priming when the pen 18 is in the uncapped position. In one implementation, service ink is deposited on the surface 320 (FIG. 3) of the shuttle 302 and on the spit platform 702 (FIG. 7). The service ink drips from surface 320 onto platform 702 or directly into the spittoon 708. Ink that drips onto the platform 702 drips or is subsequently wiped into the spittoon 708 by a squeegee or wiper, whose motion is also controlled by the shuttle 302. The squeegee or wiper moves in a direction that is coordinated with that of the spittoon plow 200. Ink that is deposited into the spittoon 708 from the surface 320 and from the spit platform 702 falls in the path of the spittoon plow 200.

In one implementation, the spittoon plow 200 is located forward of the spit platform 702 and the surface 320. The pen 18 is only uncapped during printing in one implementation, and there is little time available for much ink to drip from the surface 320 onto the platform 702 or into the spittoon 708 directly. Much of this dripping occurs as the pen 18 is capped (due to the squeegee moving the ink from the platform 702 or the ink just continuing to drip from the surface 320 into the spittoon 708). As such, the mounds of service ink that are exposed to the spittoon plow 200 are created during the capping move or when the pen 18 is capped, and the plow 200 is positioned ahead of these mounds when they are created. The plow 200 encounters and spreads these mounds of service ink in response to uncapping of the pen 18.

One implementation is directed to a service station for use with a printer, including a spittoon to receive service ink spit from an inkjet pen of the printer. The service station includes a shuttle movable along a shuttle axis, and a spittoon plow supported by the shuttle and movable with the shuttle. The spittoon plow includes at least one blade portion that is angled at a non-perpendicular angle with respect to the shuttle axis to spread the service ink along both a width and a length of the spittoon.

The spittoon plow according to one implementation extends across substantially an entire width of the spittoon. In one form of this implementation, the spittoon plow is moved from a front portion of the spittoon to a back portion of the spittoon in response to uncapping of the pen.

In one implementation, the spittoon plow includes a base portion, a first blade portion that extends horizontally away from a first side of the base, and a second blade portion that extends horizontally away from a second side of the base that is opposite the first side of the base. In one form of this implementation, the first blade portion and the second blade portion extend horizontally away from the base in opposite but substantially parallel directions. The spittoon plow according to one implementation includes a third blade portion that extends horizontally away from the second blade portion, and is angled with respect to the second blade portion. In one form of this implementation, the second blade portion has a height that is substantially the same as a height of the third blade portion, and the first blade portion has a height that is smaller than the height of the second blade portion and the third blade portion.

In one implementation, the spittoon plow includes an attachment feature sized for insertion into a cavity of the shuttle. In one form of this implementation, the attachment feature includes a trench that extends vertically upward along a side of the attachment feature, and a securing clip that extends vertically upward along the side of the attachment feature and that is aligned with the trench.

Another implementation is directed to a method for operating a service station for use with a printer. The method includes moving a shuttle supporting an angled spittoon plow in one dimension along a shuttle axis, and spreading service ink in two dimensions across a spittoon of the service station with the spittoon plow during the movement of the shuttle.

The spittoon plow according to one implementation of the method includes at least one blade portion that is angled at a non-perpendicular angle with respect to the shuttle axis. In one implementation, the spittoon plow extends across substantially an entire width of the spittoon. The method according to one implementation further includes moving the spittoon plow from a front portion of the spittoon to a back portion of the spittoon in response to uncapping of a pen of the printer.

Yet another implementation is directed to a service station for use with a printer, which includes a spittoon to receive service ink spit from an inkjet pen of the printer, and a shuttle movable in one dimension along a shuttle axis. The service station includes a spittoon plow supported by the shuttle. The spittoon plow extends across substantially an entire width of the spittoon, and is angled to spread the service ink in two dimensions across the spittoon, and has a non-vertical orientation to push the service ink downward into the spittoon.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A service station for use with a printer comprising:

a spittoon to receive service ink spit from an inkjet pen of the printer;

a shuttle movable along a shuttle axis; and a spittoon plow supported by the shuttle and movable with the shuttle, wherein the spittoon plow includes at least one blade portion that is angled at a non-perpendicular angle with respect to the shuttle axis to spread the service ink along both a width and a length of the spittoon, and wherein the spittoon plow includes a base portion, a first blade portion that extends horizontally away from a first side of the base portion, and a second blade portion that extends horizontally away from a second side of the base portion that is opposite the first side of the base portion.

2. The service station of claim 1, wherein the spittoon plow extends across substantially an entire width of the spittoon.

3. The service station of claim 2, wherein the spittoon plow is moved from a front portion of the spittoon to a back portion of the spittoon in response to uncapping of the pen.

4. The service station of claim 1, wherein the first blade portion and the second blade portion extend horizontally away from the base in opposite but substantially parallel directions.

5. The service station of claim 1, wherein the spittoon plow includes a third blade portion that extends horizontally away from the second blade portion, and is angled with respect to the second blade portion.

6. The service station of claim 5, wherein the second blade portion has a height that is substantially the same as a height of the third blade portion.

7. The service station of claim 6, wherein the first blade portion has a height that is smaller than the height of the second blade portion and the third blade portion.

8. The service station of claim 1, wherein the spittoon plow includes an attachment feature sized for insertion into a cavity of the shuttle.

9. The service station of claim 8, wherein the attachment feature includes a trench that extends vertically upward along a side of the attachment feature, and a securing clip that extends vertically upward along the side of the attachment feature and that is aligned with the trench.

10. A method for operating a service station for use with a printer comprising:

moving a shuttle supporting an angled spittoon plow in one dimension along a shuttle axis, wherein the spittoon plow includes a base portion, a first blade portion that extends horizontally away from a first side of the base portion, and a second blade portion that extends horizontally away from a second side of the base portion that is opposite the first side of the base portion; and spreading service ink in two dimensions across a spittoon of the service station with the angled spittoon plow during the movement of the shuttle and during linear motion of the angled spittoon plow.

11. The method of claim 10, wherein the spittoon plow includes at least one blade portion that is angled at a non-perpendicular angle with respect to the shuttle axis.

12. The method of claim 10, wherein the spittoon plow extends across substantially an entire width of the spittoon.

13. The method of claim 10, and further comprising:

moving the spittoon plow from a front portion of the spittoon to a back portion of the spittoon in response to uncapping of a pen of the printer.

14. A service station for use with a printer comprising:

a spittoon to receive service ink spit from an inkjet pen of the printer;

a shuttle movable in one dimension along a shuttle axis; and a spittoon plow supported by the shuttle, wherein the spittoon plow extends across substantially an entire width of the spittoon, and is angled to spread the service ink in two dimensions across the spittoon during linear motion of the spittoon plow, and has a non-vertical orientation to push the service ink downward into the spittoon, and wherein the spittoon plow includes a base portion, a first blade portion that extends horizontally away from a first side of the base portion, and a second blade portion that extends horizontally away from a second side of the base portion that is opposite the first side of the base portion.

* * * * *